US005954597A

United States Patent [19]

Smith

[11] Patent Number: 5,954,597

[45] Date of Patent: Sep. 21, 1999

[54] TETHERED BALL GAME APPARATUS

[76] Inventor: Alvin Smith, 14446 Calabay Crt., Orlando, Fla. 32827-3762

[21] Appl. No.: 08/916,145

[22] Filed: Aug. 21, 1997

[51] Int. Cl.[6] ..... A63B 69/00

[52] U.S. Cl. ..... 473/428

[58] Field of Search ..... 473/423, 424, 473/427, 428, 429, 430, 108, 109, 160, 213, 214

[56] References Cited

U.S. PATENT DOCUMENTS

| | | | |
|---|---|---|---|
| 3,550,937 | 12/1970 | Wright | 473/428 |
| 4,138,104 | 2/1979 | Janis | 473/428 |
| 4,342,459 | 8/1982 | Pretorius | 473/428 |
| 4,611,539 | 9/1986 | Watterson | 473/428 |
| 4,944,513 | 7/1990 | Zentner | 473/428 |
| 5,465,958 | 11/1995 | Brown | 473/428 |

FOREIGN PATENT DOCUMENTS

| | | | |
|---|---|---|---|
| 833350 | 3/1956 | United Kingdom | 473/213 |

*Primary Examiner*—Theatrice Brown
*Attorney, Agent, or Firm*—Edgar W. Averill, Jr.

[57] ABSTRACT

A tethered ball game apparatus for use by two players. The game includes a net supported between two vertical posts. An upright is attached to one of the posts which supports a horizontal arm. The horizontal arm in turn supports an arm which is at right angles to the net. This arm in turn holds a ball tether support arm to which a tethered ball is held. In use, the ball may be struck over the net and the tether slides along the ball tether support arm. In this way the ball never rolls far from the players so that the game may be played by persons even though they may be physically challenged.

12 Claims, 2 Drawing Sheets

TETHERED BALL GAME APPARATUS

BACKGROUND OF THE INVENTION

The field of the invention is sporting goods and the invention relates more particularly to sporting goods useful by persons who are physically challenged.

Various devices have been described which utilize a tethered ball which is substituted for an unrestrained ball. In the area of golf practice, U.S. Pat. No. 3,754,761 shows a golf ball which is held on a ring which surrounds a string. The string is attached to the ground at one end and to a raised object such as a tree at the other end. When the ball is hit, the ring rides along the string until it hits a stop. The ball then slides back down the string to the location of the golfer.

Another tethered golf game is shown in U.S. Pat. No. 5,413,347 where the golf ball is held on a string 20 which in turn is held on a hollow sleeve which is slidable along a cable. When the golfer hits the ball, the sleeve slides along the cable until it contacts a stop 56 after which it slides back to the golfer.

A baseball practice device is shown in U.S. Pat. No. 2,680,022 where a ball is held by a tether which in turn is supported on a ring. The ball is struck and, again, the ring slides along the cable to a stop and then returns.

While such apparatus is useful for a single person practicing a game, there are many two person games which are difficult for physically challenged persons to play; games such as tennis, ping pong, or racquet ball.

SUMMARY OF THE INVENTION

It is an object of the present invention to provide a tethered ball game apparatus which permits play of several different games wherein the ball is tethered and easily retrieved by the players.

The present invention is for a tethered ball game apparatus for use by two players. The apparatus has a stand supported by the floor. The stand holds an upright to which a horizontal arm is affixed. The horizontal arm in turn holds a longitudinal support arm which is held in a direction generally parallel to that of the movement of the ball in the game to be played. A ball tether support arm is held below the longitudinal support arm and supports a ball tether line having a ball on its lower end. When the longitudinal support arm is held over a net at right angles to the net, players are able to hit the ball over the net and the tether rides along the tether support arm. If one of the players misses the ball or mishits it, the ball is limited by movement by the tether and can be easily retrieved. Preferably, the upright is supported by a net assembly so that the entire game and net apparatus may be readily supported on the floor.

DESCRIPTION OF PREFERRED EMBODIMENTS

Figure 1:
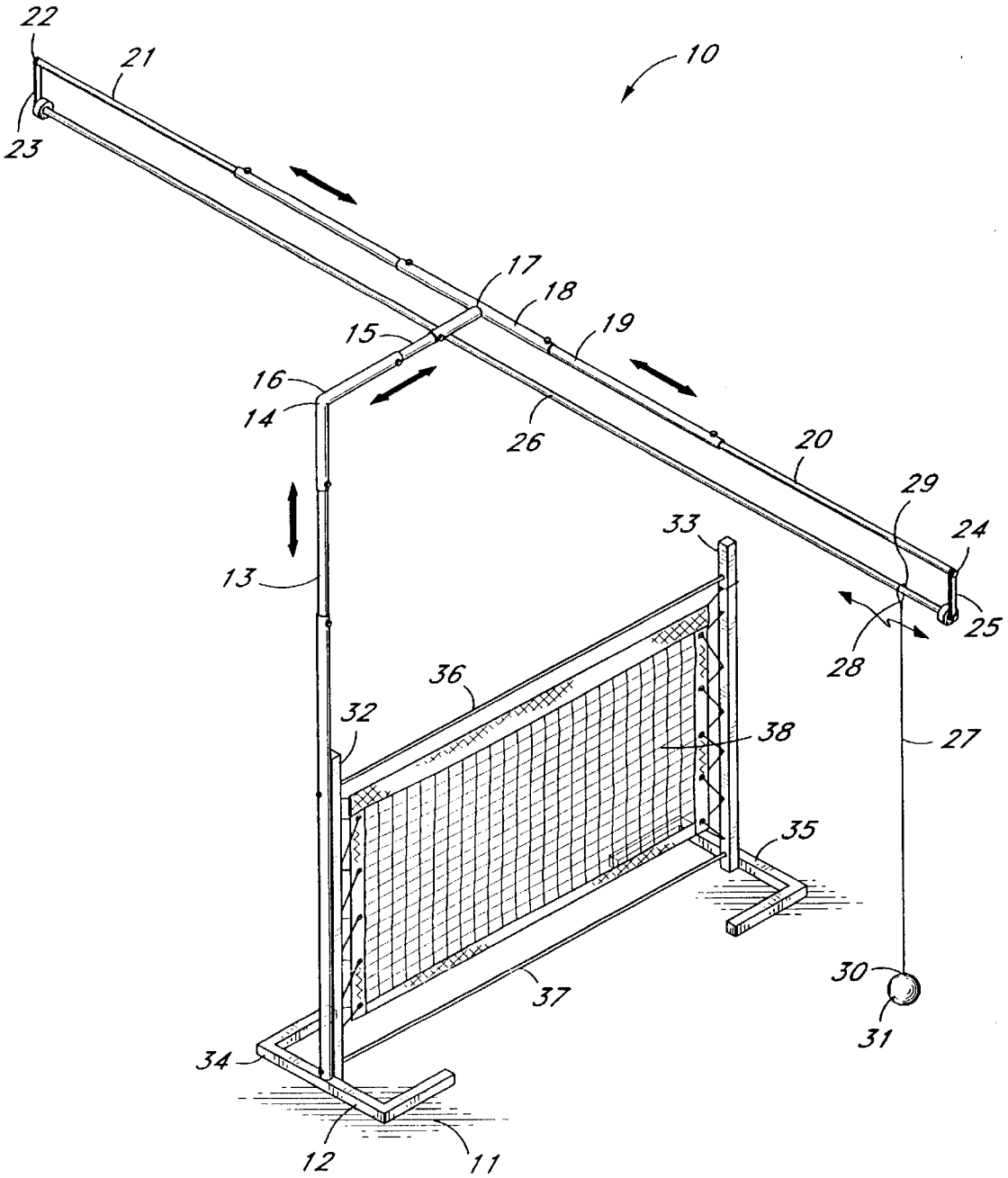
FIG. 1 is a perspective view of the tethered ball game apparatus and net of the present invention.

The tethered ball game apparatus is shown in perspective view in FIG. 1 and indicated by reference character 10. The apparatus is supported on a floor 11 which holds a stand 12. The stand in turn holds an upright 13 which has an upper end 14. A horizontal arm 15 is held at its inner end 16 to the upper end 14 of upright 13. Horizontal arm 15 has an outer terminus 17 which holds a hollow tube 18. Hollow tube 18 slidably and adjustably holds an inner tube 19. Inner tube 19 in turn adjustably holds two longitudinal support arms 20 and 21. Longitudinal support arm 21 has a first end 22 to which a tie rod 23 is held. Longitudinal support arm 20 has a second end 24 which holds a tie rod 25. A ball tether support arm 26 is held between tie rods 23 and 25. A ball tether line 27 has an upper end 28 which has a loop 29 surrounding and slidable along support arm 26. The lower end 30 of ball tether line 27 holds ball 31.

Preferably, the tethered ball game apparatus includes a net assembly. The net assembly has two vertical posts 32 and 33 supported by post support arms 34 and 35, respectively. An upper cross member 36 and a lower cross member 37 are rigid and hold the posts 32 and 33 apart. A net 38 is strung between the two vertical posts and the net and vertical post assembly provides an ideal way to hold upright 13 and its cantilevered ball tether support arm 26 over the net.

Figure 2:
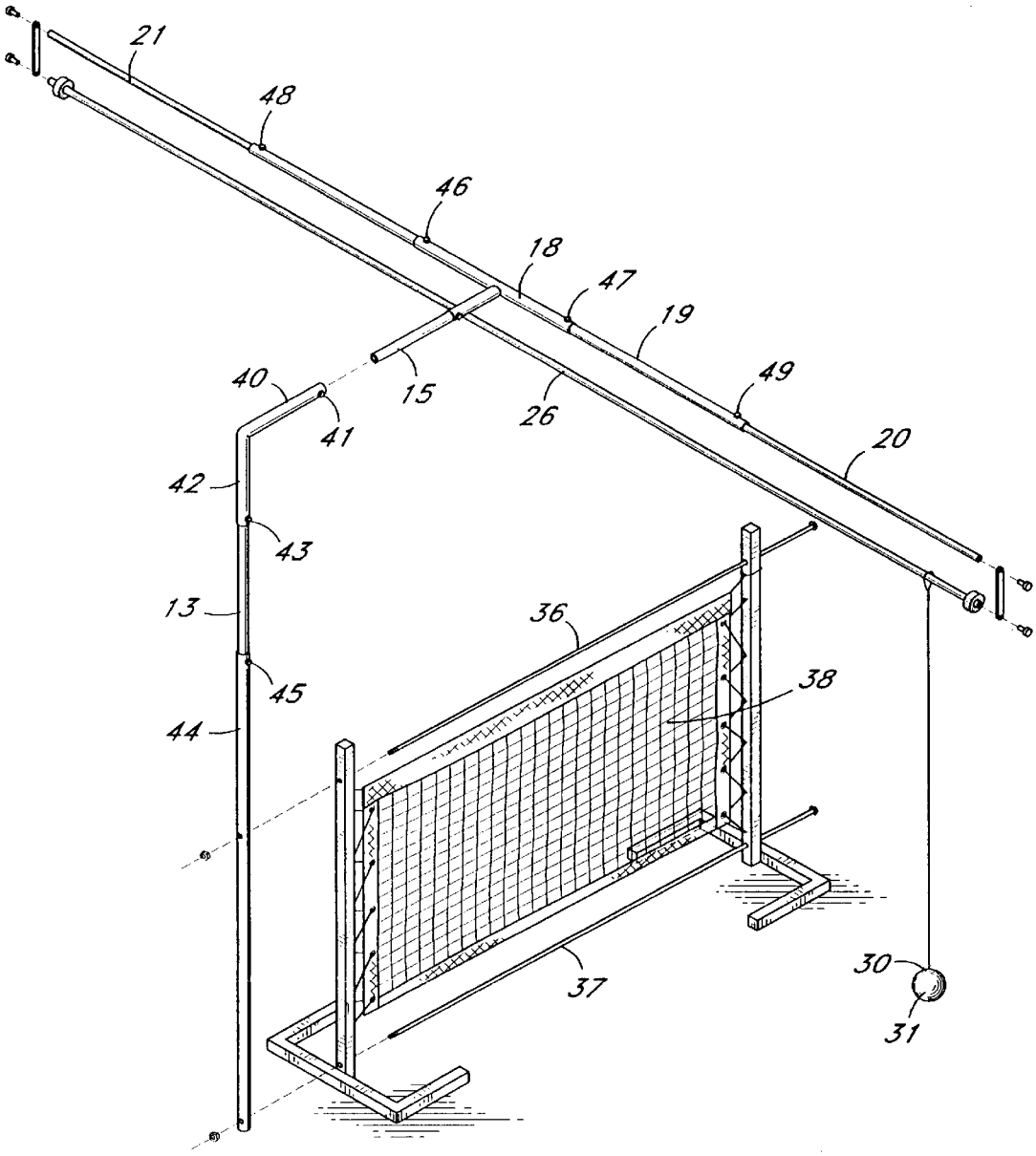
FIG. 2 is an exploded perspective view of the apparatus of FIG. 1.

The construction of the assembly is shown best in FIG. 2. Preferably, the horizontal arm 15 is adjustable and tube 40 has a tightening screw 41 which tightens against horizontal arm 15. Tube 40 is, of course, part of the horizontal arm 15. Similarly, the vertical part 42 of tube 40 is a part of upright 13 and has a tightening screw 43 permitting the adjustment of the height. Similarly, the upright 13 has a tubular portion 44 which has a tightening screw 45 which further enables the tight adjustment of upright 13. Another useful adjustment is that of the ball tether support arm 26. This may be adjusted by the tightening screws 46 and 47 on hollow tube 18 which tighten against inner tube 19. Inner tube 19 in turn has tightening screws 48 and 49 which further permit the adjustment of the position of the longitudinal support arm 20-21.

Although the drawings show a tennis setup, the longitudinal support arm 21-22 may be adjusted and a back board placed against net 38 and a game of racquet ball can be played. Also, the upright may be adjusted and the ball and tether changed to a lightweight assembly and the game of ping pong played. Thus, the apparatus of the present invention is extremely flexible and permits those who are physically challenged to enjoy many different two person games.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A tethered ball apparatus for use by two players comprising:

a base member supported on a support surface;

an upright having upper and lower ends, said lower end being attached to said base member;

a horizontal support arm having one end attached to said upper end of said upright and extending to an outer terminus;

a longitudinal support arm attached at said terminus at about a right angle to said horizontal arm, said longitudinal support arm having a first end and a second end, said longitudinal support arm being attached intermediate its ends at said terminus of said horizontal arm; and a tether support arm having a first end and a second end;

attachment means connecting said first end of said tether support arm to respective ends of sad first end and said second end of said longitudinal support arm such that said longitudinal support arm and said tether support arm is in a substantially parallel relationship; and a tether line having one end attached to said tether support arm for slidable movement along said tether support arm, and a ball attached to its other end.

2. The tethered ball apparatus of claim 1 wherein said attachment means is a tie rod; and adjustable tether stop members on said ball tether support arm, each tether stop member being positioned between said tie rods and said upper end of said ball tether line.

3. The tethered ball apparatus of claim 1 further including a net assembly, said net assembly including a pair of vertical posts, an upper and a lower cross member attached to and between said vertical posts; and a net attached to and between said pair of vertical posts and said upper and lower cross members and said upright is affixed to one of said pair of vertical posts.

4. The tethered ball apparatus of claim 1 wherein said upright is vertically adjustable.

5. The tethered ball apparatus of claim 1 wherein the length of said horizontal arm is adjustable.

6. The tethered ball apparatus of claim 1 wherein the attachment of said longitudinal support arm on said outer terminus of said horizontal arm is adjustable.

7. A tethered ball apparatus comprising:

a net assembly comprising:

first and second vertical posts, each having a support base;

upper and lower cross members attached to and between said first and second vertical posts, said cross members being rigid;

a net attached to and between said first and second vertical posts;

a tethered ball support assembly comprising:

an upright attached to one of said first and second posts, said upright extending upwardly from said support base, said upright having an upper end;

a horizontal arm having an inner end attached to said upper end of said upright and having an outer terminus, said horizontal arm being positioned above and substantially parallel to said net;

a longitudinal support arm attached at said terminus at about a right angle to said horizontal arm, said longitudinal support arm having a first end and a second end and a shaft therebetween and said longitudinal support arm being held at the terminus of said horizontal arm;

a tether support arm having a first end and a second end;

attachment means connecting said first end of said tether support arm to respective ends of said first end and said second end of said longitudinal support arm such that said longitudinal support arm and said tether support arm are in a substantially parallel relationship; and a tether line having one tend attached to said tether support arm for slidable movement along said tether support arm, and a ball attached to its other end.

8. The tethered ball apparatus of claim 7 wherein said attachment means is a tie rod; and adjustable tether stop members on said ball tether support arm, each tether stop member being positioned between said tie rods and said upper end of said ball tether line.

9. The tethered ball apparatus of claim 7 further including a net assembly, said net assembly including a pair of vertical posts, an tipper and a lower cross member attached to and between said vertical posts; and a net attached to and between said pair of vertical posts and said upper and lower cross members and said upright is affixed to one of said pair of vertical posts.

10. The tethered ball apparatus of claim 7 wherein the height of said upright is adjustable.

11. The tethered ball apparatus of claim 7 wherein the length of said horizontal arm is adjustable.

12. The tethered ball apparatus of claim 7 wherein the attachment of said longitudinal support arm on said outer terminus of said horizontal arm is adjustable.

* * * * *